US007546237B2

(12) United States Patent
Nongpiur et al.

(10) Patent No.: US 7,546,237 B2
(45) Date of Patent: Jun. 9, 2009

(54) BANDWIDTH EXTENSION OF NARROWBAND SPEECH

(75) Inventors: Rajeev Nongpiur, Burnaby (CA); Xueman Li, Barneley (CA); Phillip A. Hetherington, Port Moody (CA)

(73) Assignee: QNX Software Systems (Wavemakers), Inc., Vancouver (CA)

( * ) Notice: Subject to any disclaimer, the term of this patent is extended or adjusted under 35 U.S.C. 154(b) by 509 days.

(21) Appl. No.: 11/317,761

(22) Filed: Dec. 23, 2005

(65) Prior Publication Data

US 2007/0150269 A1 Jun. 28, 2007

(51) Int. Cl.
*G10L 19/06* (2006.01)

(52) U.S. Cl. ..... 704/209; 704/264; 704/219; 704/500

(58) Field of Classification Search ..... 704/209, 704/264, 500–504, 219
See application file for complete search history.

(56) References Cited

U.S. PATENT DOCUMENTS

| | | | | |
|---|---|---|---|---|
| 4,255,620 | A | | 3/1981 | Harris et al. |
| 4,343,005 | A | | 8/1982 | Han et al. |
| 4,700,360 | A | | 10/1987 | Visser |
| 4,741,039 | A | | 4/1988 | Bloy |
| 4,953,182 | A | | 8/1990 | Chung |
| 5,335,069 | A | | 8/1994 | Kim |
| 5,345,200 | A | | 9/1994 | Reif |
| 5,396,414 | A | | 3/1995 | Alcone |
| 5,416,787 | A | | 5/1995 | Kodoma et al. |
| 5,455,888 | A | | 10/1995 | Iyengar et al. |
| 5,497,090 | A | | 3/1996 | Macovski |
| 5,581,652 | A | | 12/1996 | Abe et al. |
| 5,771,299 | A | | 6/1998 | Melanson |
| 5,778,335 | A | * | 7/1998 | Ubale et al. ..... 704/219 |
| 5,949,796 | A | * | 9/1999 | Kumar ..... 370/529 |
| 5,950,153 | A | | 9/1999 | Ohmori et al. |
| 6,115,363 | A | | 9/2000 | Oberhammer et al. |
| 6,144,244 | A | | 11/2000 | Gilbert |
| 6,154,643 | A | | 11/2000 | Cox |

(Continued)

FOREIGN PATENT DOCUMENTS

EP 0 497 050 A3 8/1992

(Continued)

OTHER PUBLICATIONS

Ehara et al., ("A high quality 4-kbit/s speech coding algorithm based on MDP-CELP" Vehicular Technology Conference proceedings, 2000, VTC 2000-Spring Tokyo IEEE 51st, vol. 2, May 15-18, 2000, pp. 1572-1576).*

(Continued)

*Primary Examiner*—Vijay B Chawan
(74) *Attorney, Agent, or Firm*—Brinks Hofer Gilson & Lione

(57) ABSTRACT

A system extends the bandwidth of a narrowband speech signal into a wideband spectrum. The system includes a high-band generator that generates a high frequency spectrum based on a narrowband spectrum. A background noise generator generates a high frequency background noise spectrum based on a background noise within the narrowband spectrum. A summing circuit linked to the high-band generator and the background noise generator combines the high frequency spectrum and narrowband spectrum and the high frequency background noise spectrum.

27 Claims, 10 Drawing Sheets

U.S. PATENT DOCUMENTS

| | | | | |
|---|---|---|---|---|
| 6,157,682 | A | 12/2000 | Oberhammer | |
| 6,195,394 | B1 | 2/2001 | Arbeiter et al. | |
| 6,208,958 | B1 | 3/2001 | Cho et al. | |
| 6,226,616 | B1 | 5/2001 | You et al. | |
| 6,246,698 | B1 * | 6/2001 | Kumar | 370/487 |
| 6,295,322 | B1 | 9/2001 | Arbeiter et al. | |
| 6,504,935 | B1 | 1/2003 | Jackson | |
| 6,577,739 | B1 | 6/2003 | Hurtig et al. | |
| 6,615,169 | B1 | 9/2003 | Ojala et al. | |
| 6,675,144 | B1 * | 1/2004 | Tucker et al. | 704/264 |
| 6,681,202 | B1 | 1/2004 | Miet et al. | |
| 6,691,083 | B1 | 2/2004 | Breen | |
| 6,704,711 | B2 | 3/2004 | Gustafsson et al. | |
| 6,889,182 | B2 | 5/2005 | Gustafsson | |
| 6,988,066 | B2 | 1/2006 | Malah | |
| 7,046,694 | B2 * | 5/2006 | Kumar | 370/487 |
| 7,174,135 | B2 | 2/2007 | Sluijter et al. | |
| 7,181,402 | B2 * | 2/2007 | Jax et al. | 704/500 |
| 2002/0128839 | A1 | 9/2002 | Lindgren et al. | |
| 2003/0009327 | A1 | 1/2003 | Nilsson et al. | |
| 2003/0050786 | A1 | 3/2003 | Jax et al. | |
| 2003/0158726 | A1 | 8/2003 | Philippe et al. | |
| 2004/0019492 | A1 * | 1/2004 | Tucker et al. | 704/500 |
| 2004/0138876 | A1 * | 7/2004 | Kallio et al. | 704/209 |
| 2004/0148162 | A1 * | 7/2004 | Fingscheidt et al. | 704/224 |
| 2004/0158458 | A1 | 8/2004 | Sluijter et al. | |
| 2004/0174911 | A1 | 9/2004 | Kim et al. | |
| 2004/0264721 | A1 | 12/2004 | Allegro et al. | |
| 2005/0267741 | A1 * | 12/2005 | Laaksonen et al. | 704/209 |
| 2006/0293016 | A1 | 12/2006 | Giesbrecht et al. | |

FOREIGN PATENT DOCUMENTS

| | | | |
|---|---|---|---|
| EP | 0 706 299 | A3 | 4/1996 |
| WO | WO 98-06090 | A1 | 2/1998 |
| WO | WO 01-18960 | A1 | 3/2001 |
| WO | WO 02/33696 | A1 | 4/2002 |
| WO | WO 02/093562 | A | 11/2002 |
| WO | WO 2005-015952 | A1 | 2/2005 |

OTHER PUBLICATIONS

Enbom et al., ("Bandwidth expansion of speech based on vector quantization of the mel frequency cepstral coefficients" 1999 IEEE Workshop on Speech Coding Proceedings, Jun. 20-23, 1999, pp. 171-173).*

Epps et al., ("A new technique for wideband enhancement of coded narrowband speech" 1999 IEEE Workshop on Speech Coding Proceedings, Jun. 20-23, 1999, pp. 174-176).*

Iser, B., et al: "Neural Networks Versus Codebooks in an Application for Bandwidth Extension of Speech Signals," Temic Speech Dialog Systems, Soeflinger Str. 100, 89077 Ulm, Germany; Proceedings of Eurospeech 2003 (pp. 1-4).

Wolters, M., et al: "A Closer Look into MPEG-4 High Efficiency AAC," Audio Engineering Society, Convention Paper, 115th Convention, Oct. 10-13, 2003, New York, USA (pp. 1-16).

* cited by examiner

BANDWIDTH EXTENSION OF NARROWBAND SPEECH

BACKGROUND OF THE INVENTION

1. Technical Field

The invention relates to communication systems, and more particularly, to systems that extend audio bandwidths.

2. Related Art

Some telecommunication systems transmit speech across a limited frequency range. The receivers, transmitters, and intermediary devices that makeup a telecommunication network may be bandlimited. These devices may limit speech to a bandwidth that significantly reduces intelligibility and introduces perceptually significant distortion that may corrupt speech. In many telephone systems bandwidth limitations result in the characteristic sounds that may be associated with telephone speech.

While users may prefer listening to wideband speech, the transmission of such signals may require the building of new telecommunication networks that support larger bandwidths. New networks may be expensive and will likely take time to become established. Since many established networks support narrow band speech, there is a need for systems that extend signal bandwidths at receiving ends.

Bandwidth extension may be problematic. While some bandwidth extension methods reconstruct speech under ideal conditions, these methods cannot extend speech in noisy environments. Since it is difficult to model the effects of noise, the accuracy of these methods may decline in the presence of noise. Therefore, there is also a need for a system that improves the perceived quality of speech in a noisy environment.

SUMMARY

A system extends the bandwidth of a narrowband speech signal into a wideband spectrum. The system includes a high-band generator that generates a high frequency spectrum based on a narrowband spectrum. A background noise generator generates a high frequency background noise spectrum based on a background noise within the narrowband spectrum. A summing circuit linked to the high-band generator and background noise generator combines the high frequency band and narrowband spectrum with the high frequency background noise spectrum.

Other systems, methods, features, and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Bandwidth extension logic generates more natural sounding speech. When processing a narrowband speech, the bandwidth extension logic combines a portion of the narrowband speech with a high-band extension. The bandwidth extension logic may generate a wideband spectrum based on a correlation between the narrowband and high-band extension. Some bandwidth extension logic works in real-time or near real-time to minimize noticeable or perceived communication delays.

Figure 1:
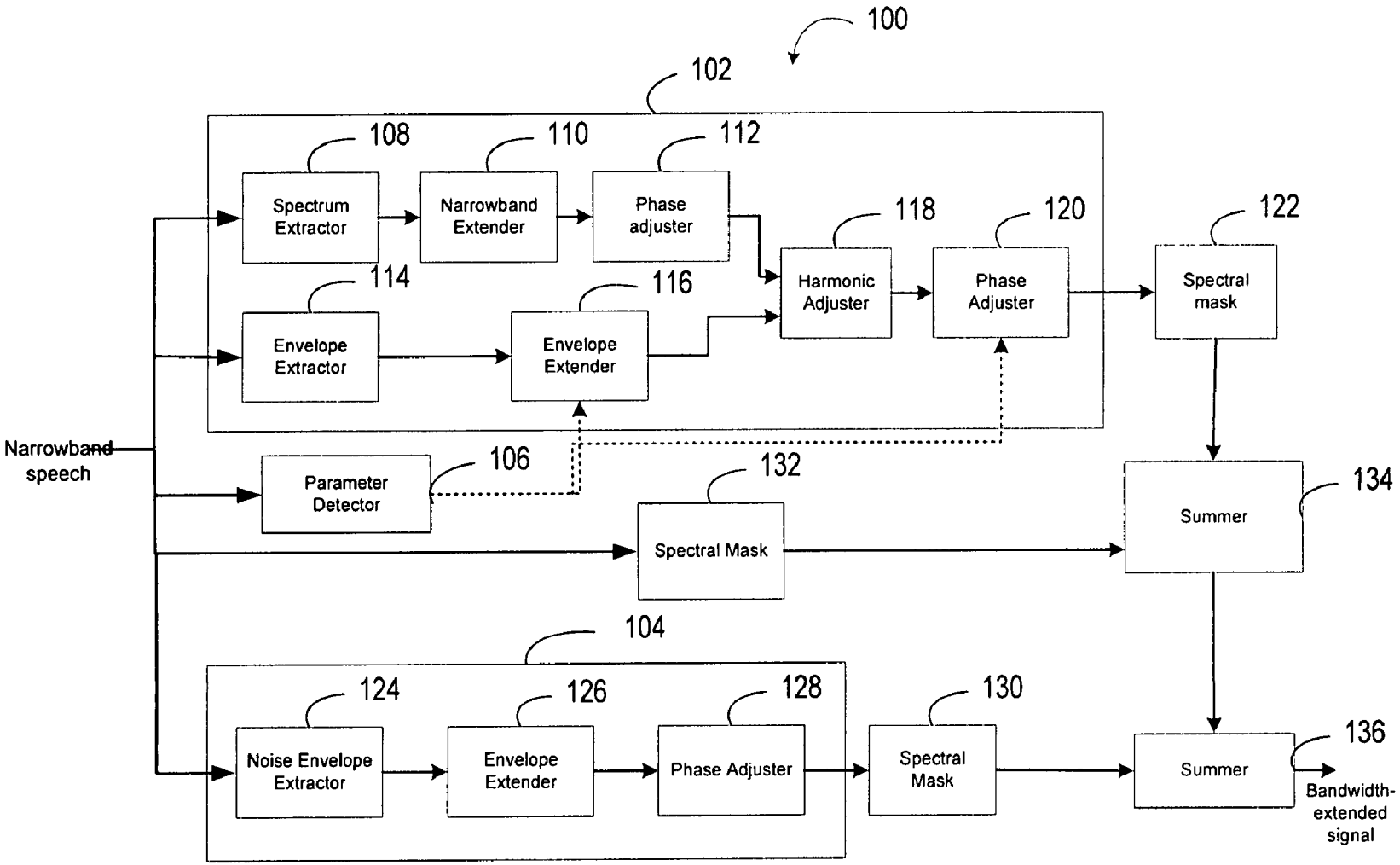
FIG. 1 is a block diagram of a bandwidth extension system.

FIG. 1 is a block diagram of bandwidth extension system 100 or logic. The bandwidth extension system 100 includes a high-band generator 102, a background noise generator 104, and a parameter detector 106. The parameter detector 106 may comprise a consonant detector or a vowel detector or a consonant/vowel detector or a consonant/vowel/no-speech detector. In FIG. 1 a narrowband speech is passed through an extractor 108 that selectively passes elements of a narrowband speech signal that lies above a predetermined threshold. The predetermined threshold may comprise a static or a dynamic noise floor that may be estimated through a preprocessing system or process. Several systems or methods may be used to extend the narrowband spectrum. In some systems, the narrowband spectrum is extended through a narrowband extender 110 that uses one or more of the systems described in U.S. application Ser. No. 11/168,654 entitled "Frequency Extension Harmonic Signals" filed Jun. 28, 2005, which is incorporated herein by reference. Other narrowband extenders or system may be used in alternate systems.

When a portion of the extended narrowband spectrum falls below a predetermined threshold (e.g., that may be a dynamic or a static noise floor) the associated phase of that portion of the spectrum is randomized through a phase adjuster 112 before the envelop is adjusted. The extended spectral envelope may be generated by a predefined transformation. In FIG. 1, the high-band envelope is derived from the narrowband signal by stretching the extracted narrowband envelope that is estimated or measured though an envelope extractor 114. A parameter detector 106 and an envelope extender 116 adjust the slope of the extended envelope that corresponds to a vowel or a consonant. The slope of the extended spectral envelope that coincides with a consonant is adjusted by a predetermined factor when a consonant is detected. A smaller adjustment to the extended spectral envelope may occur when a vowel is detected. In these systems the positive or negative inclination of the spectral envelope may not be changed by the adjustment in some systems. In these systems, the adjustment affects the rate of change of the extended spectral envelope not its direction.

To ensure that the energy in the extended narrowband spectrum (that may be referred to as the high-band extension in this system) is adjusted to the energy in the original narrowband signal, the amplitudes of the harmonics in the extended narrowband spectrum are adjusted to the extended spectral envelope through a gain adjuster or a harmonic adjuster 118. Portions of the phase of the extended narrowband that correspond to a consonant are then randomized when the parameter detector detects a consonant through a phase adjuster 120. Separate power spectral density masks filter the narrowband signal and high frequency bandwidth extension before they are combined. In FIG. 1, a first power spectral density mask 122 that passes substantially all frequencies in a signal that are above a predetermined frequency is interfaced to or is a unitary part of the high-band generator 102.

To ensure that the combined narrowband and high-band extension is more natural sounding a background noise spectrum may be added to the combined signal. In FIG. 1 the noise generator 104 generates the background noise by extracting a background noise envelope 124 and extending it through an envelope extension. An envelope extension may occur through a linear transformation or a mapping by an envelope extender 126. Random phases comprising a uniformly distributed number are then introduced into the extended background noise spectrum by a phase adjuster 128. A second power spectral density mask 130 selectively passes portions of the extended background noise spectrum that are above a predetermined frequency before it is combined with the narrowband signal and high-band extension signal.

In FIG. 1 the narrowband signal may be conditioned by a third power spectral density mask 132 that allows substantially all the frequencies below a predetermined frequency to pass through it before it is combined with the high-band extension signal through the combining logic or summing device 134 that is added to the extended background noise signal by a second summing device 136 or combining logic. The predetermined frequencies of the first power spectral density mask 122 and the second spectral density mask 132 may have complementary or substantially complementary frequency responses in FIG. 1, but may differ in alternate systems.

Figure 2:
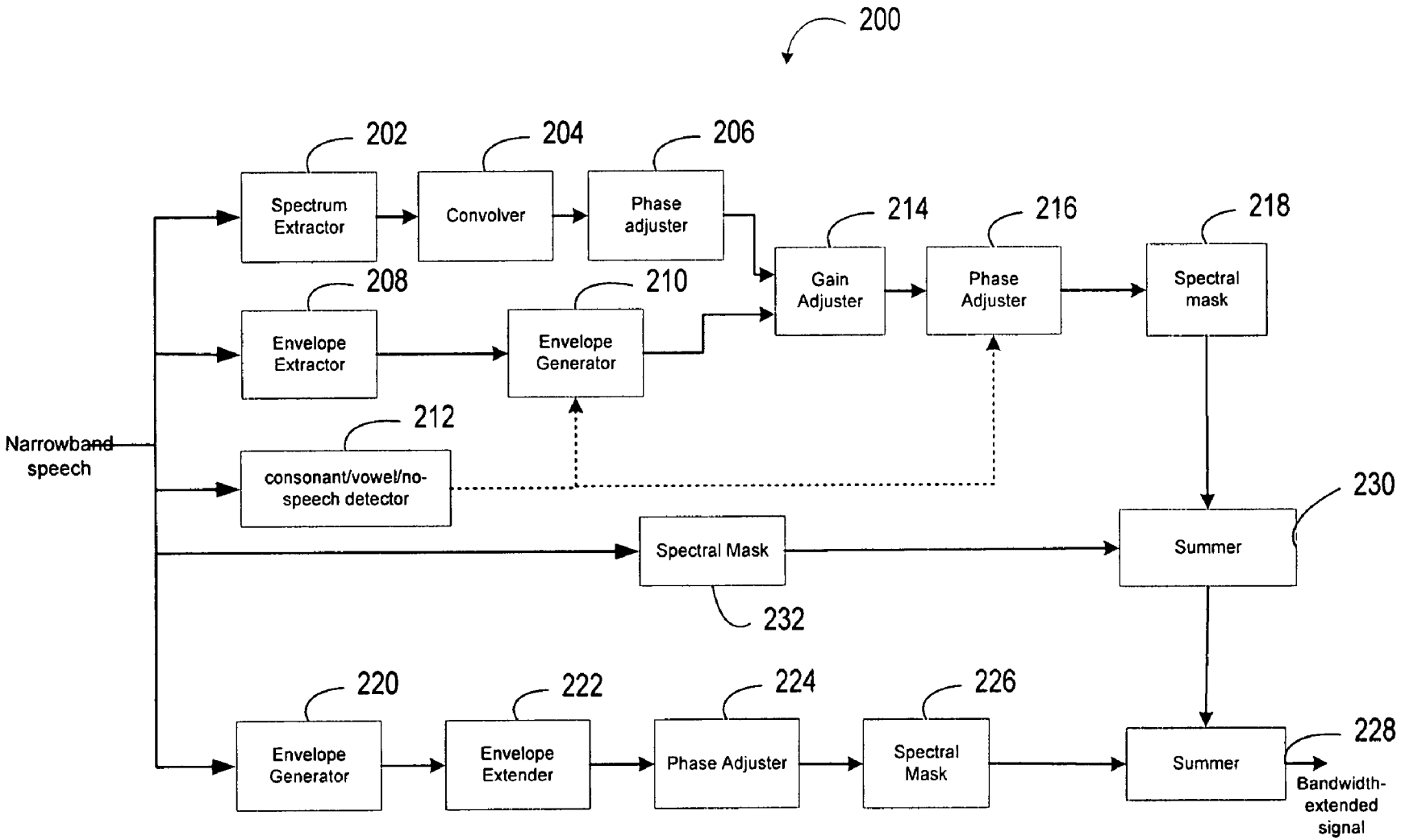
FIG. 2 is a block diagram of an alternate bandwidth extension system.

FIG. 2 is a second block diagram of an alternate bandwidth extension system 200. In this alternate system a high-band or extended speech spectrum and an extended background noise signal are generated. The extended speech and the extended background noise are then combined with the narrowband speech. The overall spectrum of the combined signal may have little or no artifacts.

In FIG. 2 the background noise spectrum $S_{BG}(f)$ is estimated from the narrowband speech spectrum $S_{SP}(f)$ through an extractor 202. The extractor 202 may separate a substantial portion of the narrowband speech spectrum from the background noise spectrum to yield a new speech spectrum $S_{newSP}(f)$. The new speech spectrum may be obtained by reducing the magnitude of the narrowband speech spectrum by a predetermined factor k, if the magnitude of the narrowband speech spectrum is below a predetermined magnitude of the background noise spectrum. If the magnitude of the narrowband speech spectrum $S_{SP}(f)$ lies above the background noise spectrum, the speech spectrum may be left unchanged. This relation may be expressed through equation 1, where k lies between about 0 and about 1.

$$|S_{newSP}(f)| = k|S_{SP}(f)| \text{ if } |S_{SP}(f)| < |S_{BG}(f)| \qquad \text{Equation 1}$$
$$= |S_{SP}(f)| \text{ if } |S_{SP}(f)| >= |S_{BG}(f)|$$

A real time or near real time convolver 204 convolves the new speech spectrum with itself to generate a high-band or extended spectrum $S_{Ext}(f)$. The systems and methods described in U.S. application Ser. No. 11/168,654 entitled "Frequency Extension Harmonic Signals" filed Jun. 28, 2005, which is incorporated herein by reference may be used.

To generate a more natural sounding speech, when the magnitude of the extended spectrum lies below a predetermined level or factor of the background noise spectrum, the phases of those portions of the extended spectrum are made random by a phase adjuster 206. This relation may be expressed in equation 2 where m lies between about 1 and about 5.

$$\text{Phase}\,[S_{newExt}(f)] = \begin{cases} \text{random}(0, 2\pi) \text{ if } |S_{Ext}(f)| < m|S_{BG}(f)| \\ \text{Phase}\,[S_{Ext}(f)] \text{ if } |S_{Ext}(f)| >= m|S_{BG}(f)| \end{cases} \qquad \text{Equation 2}$$

To adjust the envelope of the extended spectrum, the envelope of narrowband speech is extracted through an envelope extractor 208. The narrowband spectral envelope may be derived, mapped, or estimated from the narrowband signal. A spectral envelope generator 210 then estimates or derives the high-band or extended spectral envelope. In FIG. 2 the extended spectral envelope may be estimated by extending nearly all or a portion of the narrowband speech envelope. While many methods may be used, including codebook mapping, linear mapping, statistical mapping, etc., one system extends a portion of the narrowband spectral envelope near the upper frequency of the narrowband signal through a linear transform. The linear transform may be expressed as equation 3, where $w_H$ and $w_L$ are the upper and lower frequency limits of the transformed spectrum and $f_H$ and $f_L$ are the upper and lower frequency limits of the frequency band of the narrowband speech spectrum.

$$w=T(f)=\alpha(f-f_L)(w_H-w_L)/(f_H-f_L)+w_L \qquad \text{Equation 3}$$

The parameter $\alpha$ may be adjusted empirically or programmed to a predetermined value depending on whether the portion of the narrowband spectral envelope to be extended corresponds to a vowel, a consonant, or a background noise. In FIG. 2, a consonant/vowel/no-speech detector 210 coupled to the spectral envelope generator 210 adjusts the slope of the extended spectral envelope that corresponds to a vowel or a consonant. The slope of the extended spectral envelope that coincides with a consonant may be adjusted by a first predetermined factor when a consonant is detected. A second predetermined factor may adjust the extended spectral envelope when a vowel is detected. Because some consonants have a greater concentration of energy in the higher end of the frequency band while some vowels have greater concentration of energy in the middle and lower end of the frequency band, the first predetermined factor may be greater than the second predetermined factor in some systems. In FIG. 2, a larger slope adjustment of the extended spectral envelope occurs when a consonant is detected than when a vowel is detected.

Figure 3:
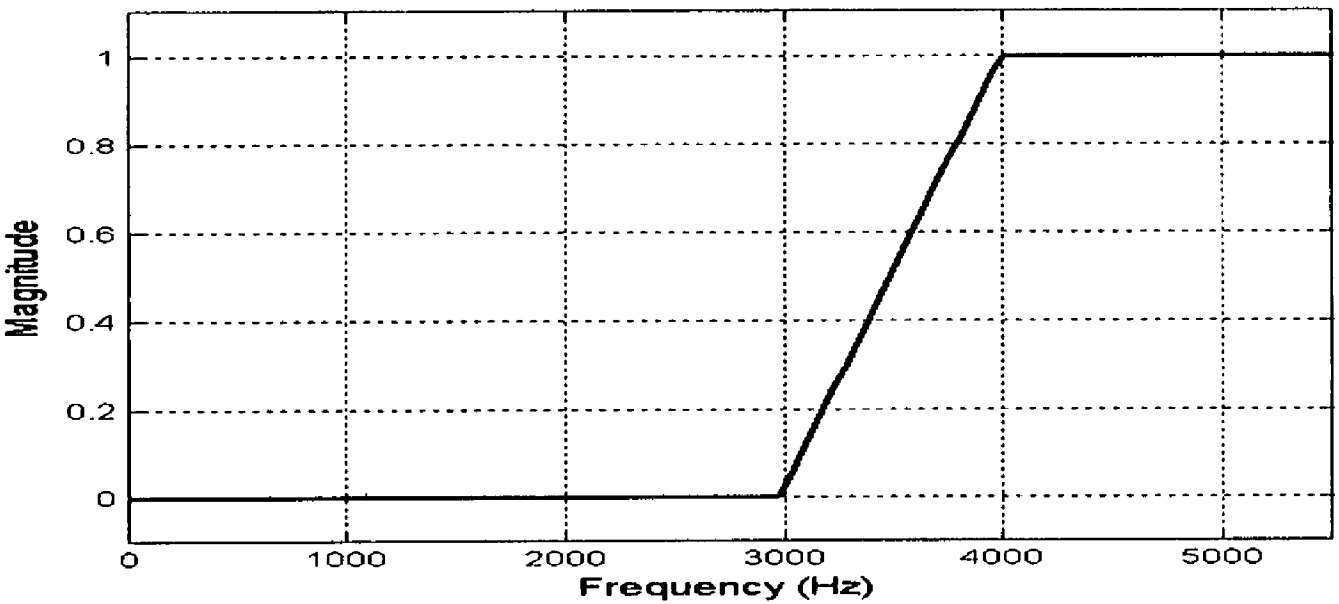
FIG. 3 is a frequency response of a first power spectral density mask.

To ensure that the energy in the extended spectrum matches the energy in the narrowband spectrum, the harmonics in the extended narrowband spectrum are adjusted to the extended spectral envelope through a gain adjuster 214. Adjustment may occur by scaling the extended narrowband spectrum so that the energy in a portion of the extended spectrum is almost equal or substantially equal to the energy in a portion of the narrowband speech spectrum. Portions of the phase of the extended narrowband signal that correspond to a consonant are then randomized by a phase adjuster 216 when the consonant/vowel/no-speech detector detects a consonant. Separate power spectral density masks filter the narrowband speech signal and the extended narrowband signal before the signals are combined through combining logic or a summer 250. In FIG. 2, a first power spectral density mask 218 passes frequencies of the extended spectrum that are above a predetermined frequency. In some systems having an upper break frequency near 5,500 Hz, the power spectral density mask may have the frequency response shown in FIG. 3.

To make the bandwidth of the extended spectrum sound more natural, a background noise may be extended separately and then added to the combined bandwidth extended and narrowband speech spectrum. In some systems the extended background noise spectrum has random phases with a consistent envelope slope.

In FIG. 2, the narrowband background noise spectral envelope is derived or estimated from the background noise spectrum through a spectral envelope generator 220. A spectral envelope extender 222 estimates, maps, or derives the highband background noise or extended background noise envelope. In FIG. 2 the extended background noise envelope may be estimated by extending nearly all or a portion of the narrowband background noise envelope. While many methods may be used including codebook mapping, linear mapping, statistical mapping, etc., one system extends a portion of the narrowband noise envelope near the upper frequency of the narrowband through a linear transform. The linear transform may be expressed by equation 3, where $w_H$ and $w_L$ are the upper and lower frequency limits of the transformed spectrum and $f_H$ and $f_L$ are the upper and lower frequency limits of the frequency band of the narrowband noise spectrum. The $$w=T((f)=\alpha(f-f_L)(w_H-w_L)/(f_H-f_L)+w_L \qquad \text{Equation 3}$$

parameter $\alpha$ may be adjusted empirically or may be programmed to a predetermined value.

Random phases consisting of uniformly distributed numbers between about 0 and about $2\pi$ are introduced into the extended background noise spectrum through a phase adjuster 224 before it is filtered by a power spectral density mask 226. The power spectral density mask 226 selectively passes portions of the extended background noise spectrum that are above a predetermined frequency before it is combined through combining logic or a summer 228 with the narrowband speech and extended spectrum. In those systems having an upper break frequency near about 5,500 Hz, the power spectral density mask may generate the frequency response shown in FIG. 3.

Figure 4:
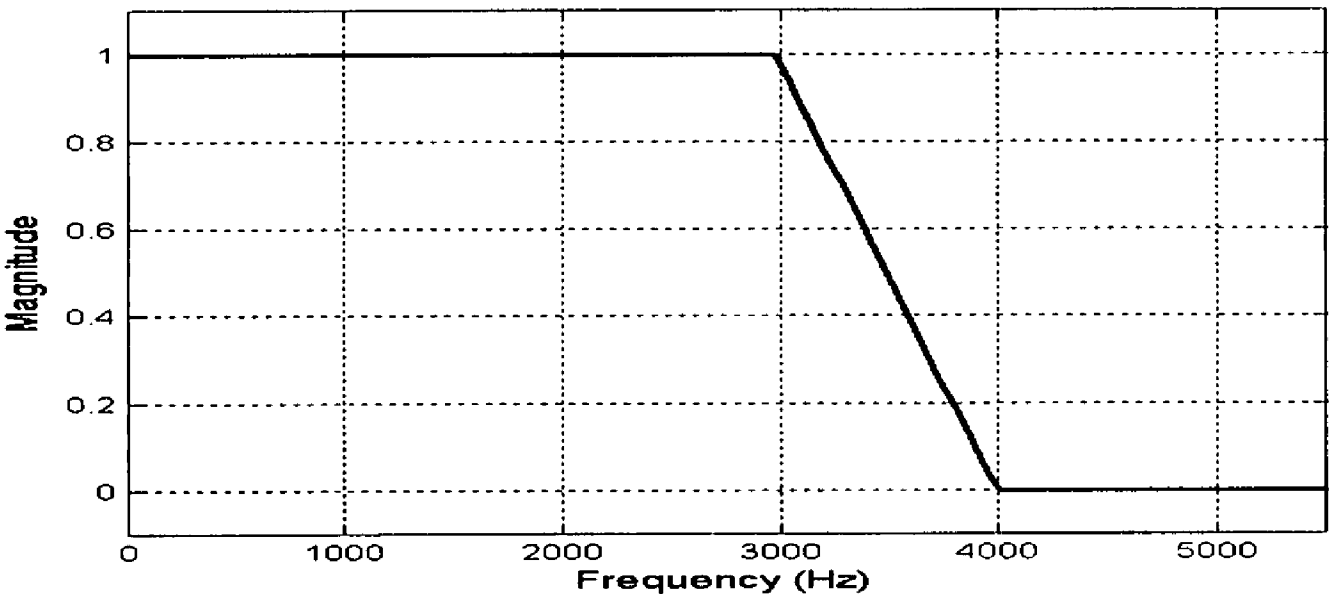
FIG. 4 is a frequency response of a second power spectral density mask.

In FIG. 2 the narrowband signal may be conditioned by a power spectral density mask 232 that allows substantially all the frequencies below a predetermined frequency to pass through it before it is combined with the extended narrowband and extended background noise spectrum. In some systems having a break frequency near about 3,500 Hz, the power spectral density mask 232 may have a frequency response shown in FIG. 4.

In FIG. 2, the consonant/vowel/no-speech detector 212 may decide the slope of the envelope of the extended spectrum based on whether it is a vowel, consonant, or no-speech region and/or may identify those potions of the extended spectrum that should have a random phase. When deciding if a spectral band or frame falls in a consonant, vowel, or no-speech region, the consonant/vowel/no-speech detector 212 may process various characteristics of the narrowband speech signal. These characteristics may include the amplitude of the background noise spectrum of the narrowband speech signal, or the energy $E_L$ in a certain low-frequency band that is above a background noise floor, or a measured or estimated ratio $\gamma$ of the energy in a certain high-frequency band to the energy in a certain low-frequency band, or the energy of the narrowband speech spectrum that is above a measured or an estimated background noise, or a measured or an estimated change in the spectral energy between frames or any combination of these or other characteristics.

Some consonant/vowel/no-speech detectors 212 may detect a vowel or a consonant when a measured or an estimated $E_L$ and/or $\gamma$ lie above or below a predetermined threshold or within a predetermined range. Some bandwidth extension systems recognize that some vowels have a greater value of $E_L$ and a smaller value of $\gamma$ than consonants. The spectral estimates or measures and decisions made on previous frames may also be used to facilitate the consonant/vowel decision in the current frame. Some bandwidth extension systems detect no-speech regions, when energy is not detected above a measured or derived background noise floor.

Figure 5:
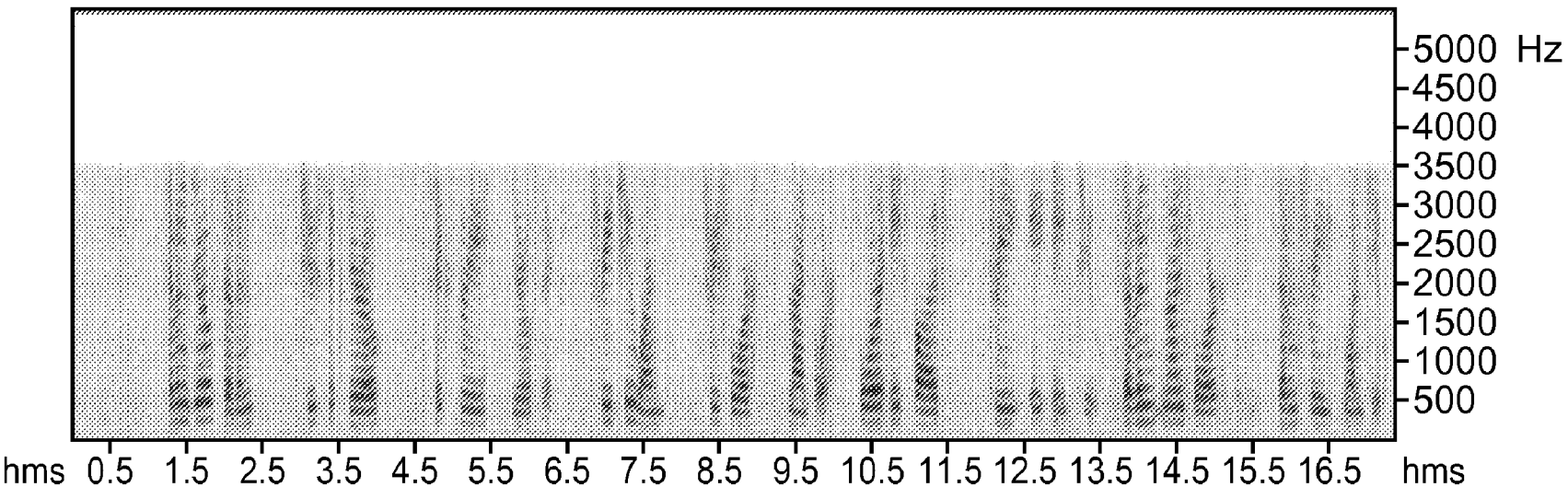
FIG. 5 is the frequency spectra of a narrowband speech.
Figure 6:
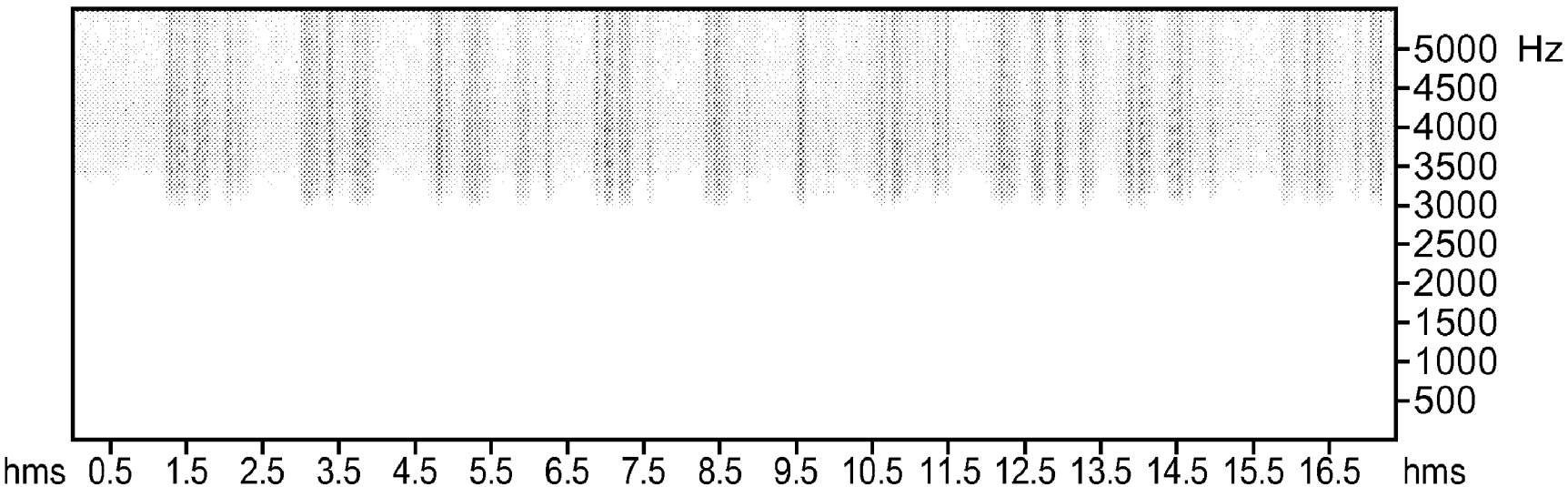
FIG. 6 is the frequency spectra of a reconstructed wideband speech.
Figure 7:
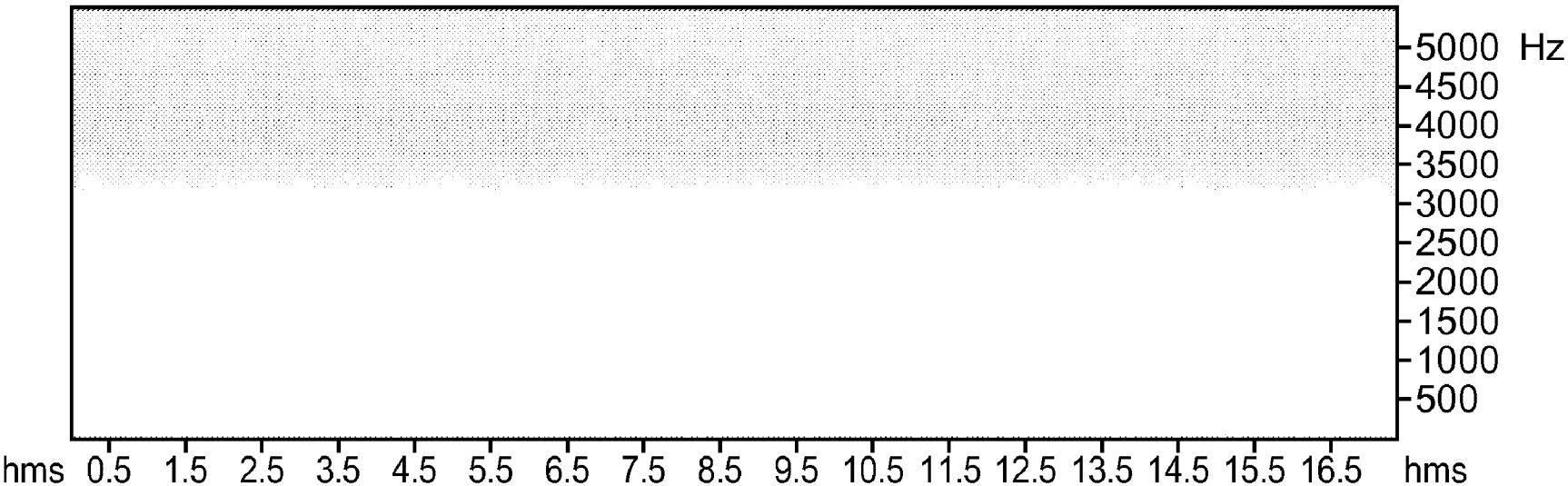
FIG. 7 is the frequency spectra of a background noise.
Figure 8:
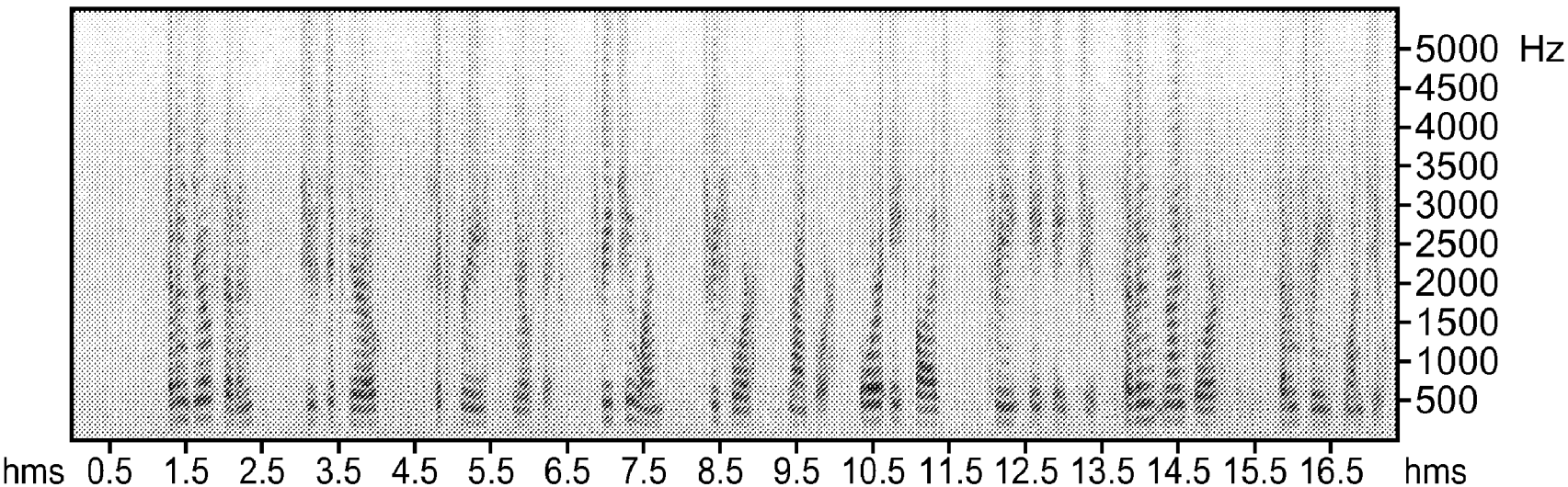
FIG. 8 is the frequency spectra of a narrowband spectrum added to a high-band spectrum added to an extended background noise spectrum.
Figure 9:
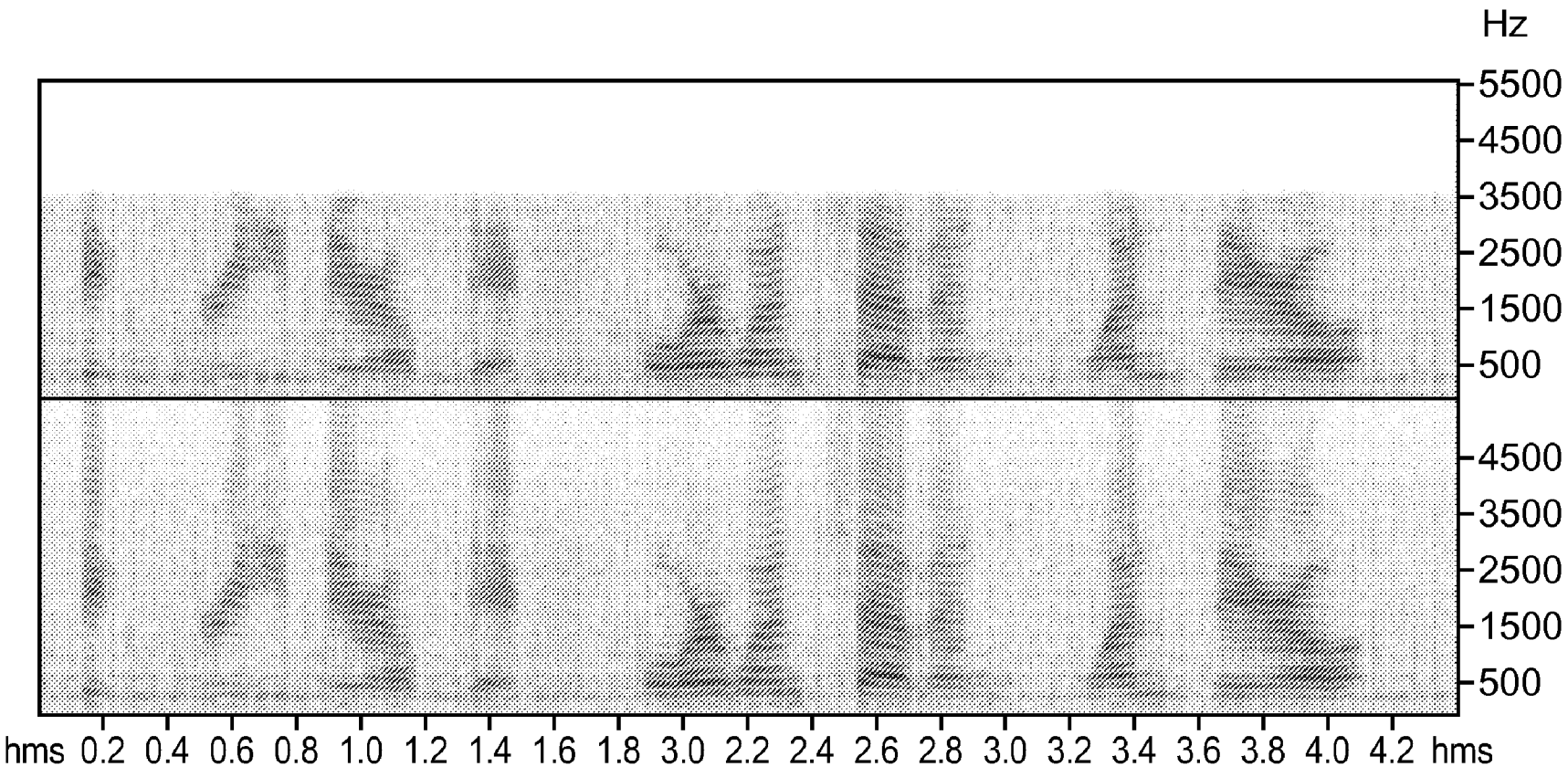
FIG. 9 is frequency spectra of a narrowband speech (top) and reconstructed wideband speech (bottom).

FIGS. 5-9 depict various spectrograms of a speech signal. FIG. 5 shows the spectrogram of a narrowband speech signal recorded in a stationary vehicle that was passed through a Code Division Multiple Access (CDMA) network. In FIG. 6, the bandwidth extension system accurately estimates or derives the highband spectrum from the narrowband spectrum shown in FIG. 5. In FIG. 6, only the extended signal is shown. FIG. 7 is a spectrogram of an exemplary background noise spectrum. Because the level of background noise in the narrowband speech signal is low, the magnitude of the extended background noise spectrum is also low. FIG. 8 is a spectrogram of the bandwidth extended signal comprising the narrowband speech spectrum added to the extended signal spectrum added to the extended background noise spectrum. FIG. 9 shows the spectrogram of a narrowband speech signal (top) and the reconstructed wideband speech (bottom). In FIG. 9, the narrowband speech was recorded in a vehicle moving about 30 kilometers/hour that was then passed through a CDMA network. As shown, the bandwidth extension system accurately estimates or derives the highband spectrum from the narrowband spectrum.

Figure 10:
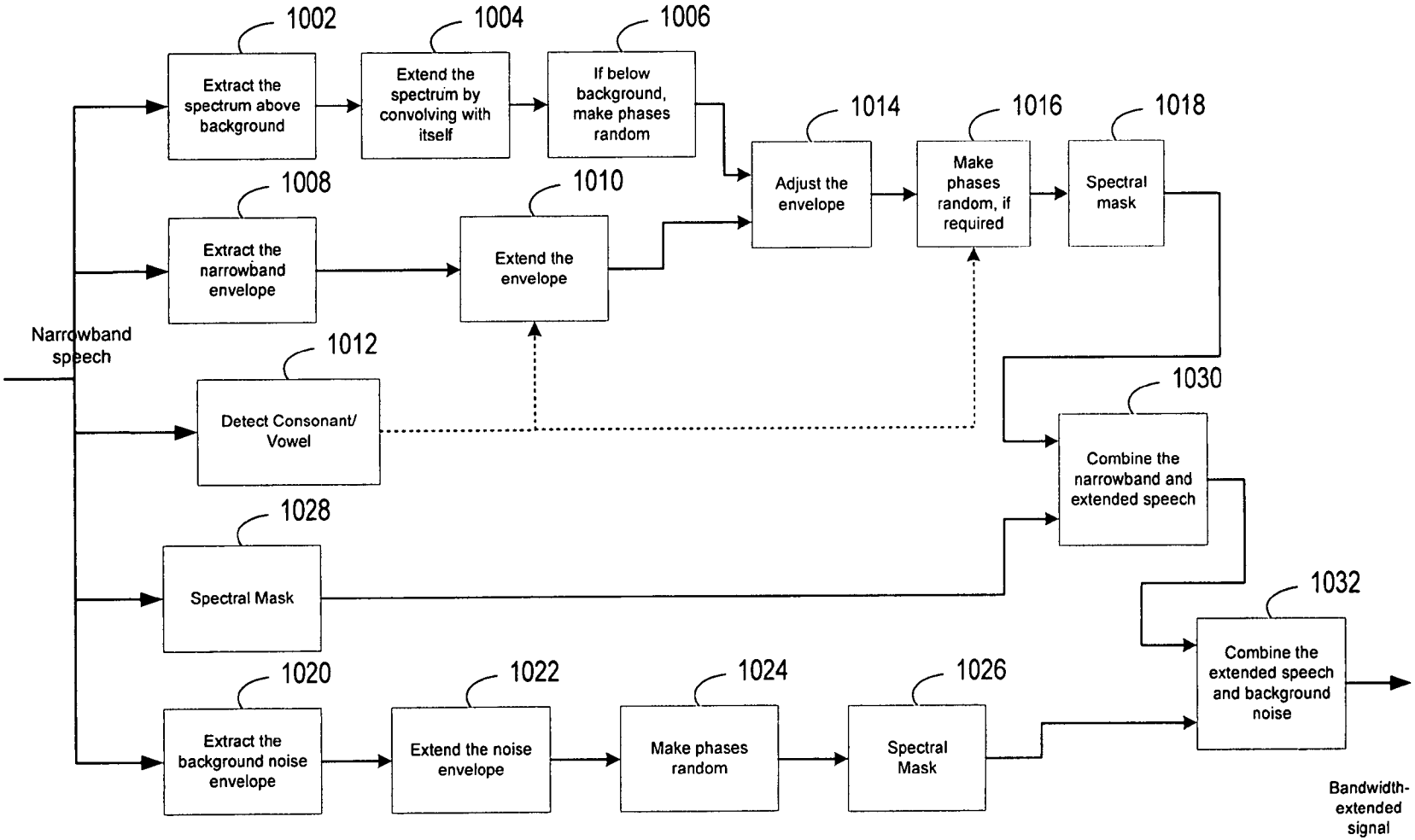
FIG. 10 is a flow diagram that extends a narrowband signal.

FIG. 10 is a flow diagram that extends a narrowband speech signal that may generate a more natural sounding speech. The method enhances the quality of a narrowband speech by reconstructing the missing frequency bands that lie outside of the pass band of a bandlimited system. The method may improve the intelligibility and quality of a processed speech by recapturing the discriminating characteristics that may only be heard in the high-frequency band.

In FIG. 10 a narrowband speech is passed through an extractor that selectively passes, measures, or estimates elements of a narrowband speech signal that lies above a predetermined threshold at act 1002. The predetermined threshold may comprise a static or dynamic noise floor that may be measured or estimated through a pre-processing system or process. Several methods may be used to extend the narrowband spectrum at act 1004. In some methods, the narrowband spectrum is extended through one or more of the methods described in U.S. application Ser. No. 11/168,654 entitled "Frequency Extension Harmonic Signals" filed Jun. 28, 2005. Other methods are used in alternate systems.

When a portion of the extended narrowband spectrum falls below a predetermined threshold (e.g., that may be a dynamic or a static noise floor) the associated phase of that is randomized at act 1006 before the extended envelop is adjusted. In FIG. 10, a high-band envelope (e.g., the extended narrowband envelope) is derived or extracted from the narrowband signal at act 1008 before it is extended at act 1010. A parameter detection (in this method shown as a process that detects consonant/vowel/no-speech at act 1012) is used to adjust the slope of the extended envelope that corresponds to a vowel or a consonant at act 1010. The slope of the extended spectral envelope that coincides with a consonant is adjusted by a predetermined factor when a consonant is detected. An adjustment to the extended spectral envelope may occur when a vowel is detected. In some methods the positive or negative inclination of portions of the extended spectral envelope may not be changed by the adjustment. Rather the adjustment affects the rate of change of the extended spectral envelope.

To ensure that the energy in the extended narrowband spectrum (that may be referred to as the high-band extension) is adjusted to the energy in the original narrowband signal, the amplitude or gain of the harmonics in the extended narrowband spectrum is adjusted to the extended spectral envelope at act 1014. Portions of the phase of the extended narrowband that correspond to a consonant are then randomized when a consonant is detected at acts 1012 and 1016. Separate power spectral density masks filter the narrowband signal and high frequency bandwidth extension before they are combined. In FIG. 10 a first power spectral density mask passes substantially all frequencies in a signal that are above a predetermined frequency at 1018.

To ensure that the combined narrowband and high-band extension is more natural sounding a background noise spectrum may be added to the combined signal. At act 1020, a background noise envelope is extracted and extended at act 1022 through an envelope extension. Envelope extension may occur through a linear transformation, a mapping, or other methods. Random phases are then introduced into the extended background noise spectrum at act 1024. A second power spectral density mask selectively passes portions of the extended background noise spectrum at act 1026 that are above a predetermined frequency before it is combined with the narrowband signal and high-band extension signal at act 1032.

In FIG. 10 the narrowband signal may be conditioned by a third power spectral density mask that allows substantially all the frequencies below a predetermined frequency to pass through it at act 1028 before it is combined with the high-band extension signal at act 1030 and the extended background noise signal at act 1032. The predetermined frequency responses of the first power spectral density mask and the second spectral may be substantially equal or may differ in alternate systems.

Each of the systems and methods described above may be encoded in a signal bearing medium, a computer readable medium such as a memory, programmed within a device such as one or more integrated circuits, or processed by a controller or a computer. If the methods are performed by software, the software may reside in a memory resident to or interfaced to the high-band generator 102, the background noise generator 104, and/or the parameter detector 106 or any other type of non-volatile or volatile memory interfaced, or resident to the speech enhancement logic. The memory may include an ordered listing of executable instructions for implementing logical functions. A logical function may be implemented through digital circuitry, through source code, through analog circuitry, or through an analog source such through an analog electrical, or optical signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any apparatus that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

While some systems extend or map narrowband spectra to wideband spectra, alternate systems may extend or map a portion or a variable amount of a spectra that may lie anywhere at or between a low and a high frequency to frequency spectra at or near a high frequency. Some systems extend encoded signals. Information may be encoded using a carrier wave of constant or an almost constant frequency but of varying amplitude (e.g., amplitude modulation, AM). Information may also be encoded by varying signal frequency. In these systems, FM radio bands, audio portions of broadcast television signals, or other frequency modulated signals or bands may be extended. Some systems may extend AM or FM radio signals by a fixed or a variable amount at or near a high frequency range or limit.

Some other alternate systems may also be used to extend or map high frequency spectra to narrow frequency spectra to create a wideband spectrum. Some system and methods may also include harmonic recovery systems or acts. In these systems and/or acts, harmonics attenuated by a pass band or hidden by noise, such as a background noise may be reconstructed before a signal is extended. These systems and/or acts may use a pitch analysis, code books, linear mapping, or other methods to reconstruct missing harmonics before or during the bandwidth extension. The recovered harmonics may then be scaled. Some systems and/or acts may scale the harmonics based on a correlation between the adjacent frequencies within adjacent or prior frequency bands.

Some bandwidth extension systems extend the spectrum of a narrowband speech signal into wideband spectra. The bandwidth extension is done in the frequency domain by taking a short-time Fourier transform of the narrowband speech signal. The system combines an extended spectrum with the narrowband spectrum with little or no artifacts. The bandwidth extension enhances the quality and intelligibility of speech signals by reconstructing missing bands that may make speech sound more natural and robust in different levels of background noise. Some systems are robust to variations in the amplitude response of a transmission channel or medium.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A system that extends the bandwidth of a narrowband speech signal comprising:

a high-band generator that generates a high frequency spectrum based on a narrowband spectrum;

a background noise generator that generates a high frequency background noise spectrum based on a background noise within the narrowband spectrum; and a summer coupled to the high-band generator and background noise generator that combines the high frequency band and narrowband spectrum with high frequency background noise spectrum.

2. The system of claim 1, where the high-band generator comprises a narrowband spectrum extractor coupled to a narrowband extender.

3. The system of claim 2, where the high-band generator further comprises a phase adjuster that adjusts the phase of a portion of the high frequency spectrum when the narrowband spectrum falls below a predetermined threshold.

4. The system of claim 1, where the high-band generator further comprises an envelope extractor coupled to an envelope extender that generates a high frequency spectral envelope.

5. The system of claim 4, further comprising a parameter detector coupled to the envelope extender that identifies portions of the high frequency spectral envelope to be adjusted based on a detected parameter.

6. The system of claim 5, where the detected parameter comprises a consonant or a vowel.

7. The system of claim 6 where the envelope extender is configured to adjust the high frequency spectral envelope by a first adjustment when the consonant is detected and a second adjustment when a vowel is detected.

8. The system of claim 1, where the background noise generator comprises a noise envelope detector coupled to a spectral envelope extender coupled to the summer.

9. The system of claim 8, where the background noise generator further comprises a phase adjuster disposed between the spectral envelope detector and the summer.

10. The system of claim 1 further comprising a plurality of spectral masks coupled to the summer that have differing frequency responses.

11. The system of claim 1 where the high-band generator that generates a high frequency spectrum is configured to convolve the narrowband spectrum with itself.

12. The system of claim 1, where the high-band generator further comprises a first phase adjuster that adjusts the phase of a portion of the high frequency spectrum when the narrowband spectrum falls below a predetermined threshold and a second phase adjuster that adjusts the phase of a second portion of the high frequency spectrum when a consonant is detected.

13. The system of claim 12 where the second phase adjuster is configured to randomize the phase of the second portion of the high frequency spectrum when a parameter detector detects the consonant.

14. The system of claim 1, where the narrowband spectrum comprises a narrowband spectrum of the narrowband speech signal.

15. A system that extends the bandwidth of a narrowband speech signal comprising:

a spectrum extractor that obtains a narrowband speech spectrum from a narrowband spectrum;

a convolver configured to generate a high frequency spectrum by convolving the narrowband speech spectrum with itself;

a high frequency envelope generator configured to generate a high frequency spectral envelope from the narrowband spectrum;

a spectral envelope extender that estimates a high frequency background noise based on the narrowband spectrum; and a summer configured to combine the narrowband spectrum, the high frequency spectrum, and the high frequency background noise.

16. The system of claim 15 further comprising a consonant or a vowel detector coupled to the high frequency envelope generator.

17. The system of claim 16 further comprising a first phase adjuster that adjusts the phase of the high frequency spectrum when the magnitude of the high frequency spectrum lies below a predetermined level.

18. The system of claim 15 further comprising a gain adjuster configured to adjust the gain of the high frequency spectrum based on the high frequency spectral envelope.

19. The system of claim 15, where the narrowband spectrum comprises a narrowband spectrum of the narrowband speech signal.

20. A method of extending a narrowband speech signal into a wideband signal comprising:

extracting a narrowband spectrum that lies above a background noise band spectrum;

extending the narrowband spectrum into a high frequency band spectrum;

generating a high frequency band spectral envelope;

adjusting a portion of the energy of the high frequency band spectrum to a portion of the energy in the narrowband spectrum;

generating a high frequency background noise spectrum; and adding the adjusted high frequency band spectrum to the narrowband spectrum and the generated background noise spectrum.

21. The method of 20 where the act of extending the narrowband spectrum comprises convolving the narrowband spectrum with itself.

22. The method of claim 20 further comprising adjusting the high frequency band spectral envelope when a consonant is detected.

23. The method of claim 20, where the narrowband spectrum comprises a narrowband spectrum of the narrowband speech signal.

24. The method of claim 20, where the act of generating the high frequency background noise spectrum comprises:

extracting a background noise envelope from the narrowband spectrum; and extending the background noise envelope into a higher frequency range.

25. The method of claim 20, further comprising introducing random phases to the high frequency background noise spectrum.

26. A system that extends the bandwidth of a narrowband speech signal comprising:

a high-band generator that generates a high frequency spectrum based on a narrowband spectrum;

a background noise envelope extractor that determines a background noise envelope of the narrowband spectrum;

a background noise envelope extender that generates a high frequency background noise spectrum from the background noise envelope of the narrowband spectrum; and a summer configured to combine the high frequency spectrum, the narrowband spectrum, and the high frequency background noise spectrum.

27. The system of claim 26, further comprising a phase adjuster that introduces random phases to the high frequency background noise spectrum.

* * * * *